United States Patent [19]

Allison

[11] Patent Number: 4,541,140

[45] Date of Patent: Sep. 17, 1985

[54] COMBINATION COUPLER AND SUPPORT BEARING FOR A PAINT ROLLER

[75] Inventor: Philip J. Allison, Renforth, Canada

[73] Assignee: T. S. Simms & Co. Limited, Saint John, Canada

[21] Appl. No.: 593,399

[22] Filed: Mar. 26, 1984

[30] Foreign Application Priority Data

May 18, 1983 [CA] Canada ..... 428455

[51] Int. Cl.[4] ..... B05C 17/02

[52] U.S. Cl. ..... 15/230.11; 401/197; 403/290

[58] Field of Search ..... 401/197; 15/230.11; 403/289, 290

[56] References Cited

U.S. PATENT DOCUMENTS

| | | | |
|---|---|---|---|
| 3,623,179 | 11/1971 | Roth | 15/230.11 X |
| 4,316,301 | 2/1982 | Smith et al. | 15/230.11 |

FOREIGN PATENT DOCUMENTS

| | | | |
|---|---|---|---|
| 1451378 | 7/1966 | France | 401/197 |
| 2505210 | 11/1982 | France | 15/230.11 |
| 887761 | 1/1962 | United Kingdom | 15/230.11 |
| 2046596 | 11/1980 | United Kingdom | 15/230.11 |

*Primary Examiner*—Steven A. Bratlie

*Attorney, Agent, or Firm*—Fetherstonhaugh & Co.

[57] ABSTRACT

A combination coupler and support bearing for a paint roller coater has a mounting socket formed inwardly of a plurality of fingers which are resiliently retained against outward deflection by means of a circumscribing O-ring.

2 Claims, 5 Drawing Figures

COMBINATION COUPLER AND SUPPORT BEARING FOR A PAINT ROLLER

This invention relates to a combination coupler and support bearing for a paint roller.

PRIOR ART

In U.S. Pat. No. 4,316,301, dated Feb. 23, 1983, a paint roller of the type to which the present invention relates, is disclosed. While this snap-on type of paint roller has proved satisfactory, some difficulty has been experienced in attempting to ensure that snap-on fit obtained between the plug and socket has a consistent interference fit. We have found that moulded plastic components such as these couplers difficulty is experienced in obtaining a uniform interference fit over an extended period of time. We further, found that professional painters find it desirable to have an interference fit which is substantially greater than that preferred by the home decorator. I have found that these difficulties can be overcome by forming the socket from a plurality of locking fingers which are circumferentially spaced from one another, but which are surrounded by and embraced by a resilient member such as an O-ring.

I have further found that by clamping an O-ring between the resilient locking fingers and reinforcing a rib of the bearing, I can secure the O-ring at any one of a number of positions along the length of the clamping fingers, thereby varying the compressive loads which are applied to the locking ring, thereby to vary the interference fit as required. This permits me to position the ring in one location when a bearing suitable for a professional is required and to position it in another location when a bearing suitable for a home decorator is required.

According to one aspect of the present invention, there is provided a combination coupler and support bearing comprising an end wall, roller support means projecting from said end wall and adapted to fit within an end of tubular support of a paint roller, a plurality of locking fingers projecting from said end wall, each of said fingers having a free outer end spaced a substantial distance from said end wall, said locking fingers being circumferentially spaced with respect to one another, and forming a socket radially inwardly thereof, said locking fingers being flexible to permit a plug to enter said socket, said locking fingers being spaced radially inwardly from said roll support means to provide an annular recess therebetween, which extends a substantial distance inwardly from the free outer ends of the fingers toward the end wall, a resilient clamping member mounted in said recess and applying a radially, inwardly directed compressor force to the locking fingers serving to urge the locking fingers inwardly into locking engagement, with the plug positioned in said socket in use.

The invention will be more clearly understood after reference to the following detailed specification read in conjunction of the drawings, wherein FIG. 1 is a pictorial view of a paint roller constructed in accordance with an embodiment of the present invention.

Figures 1, 2:
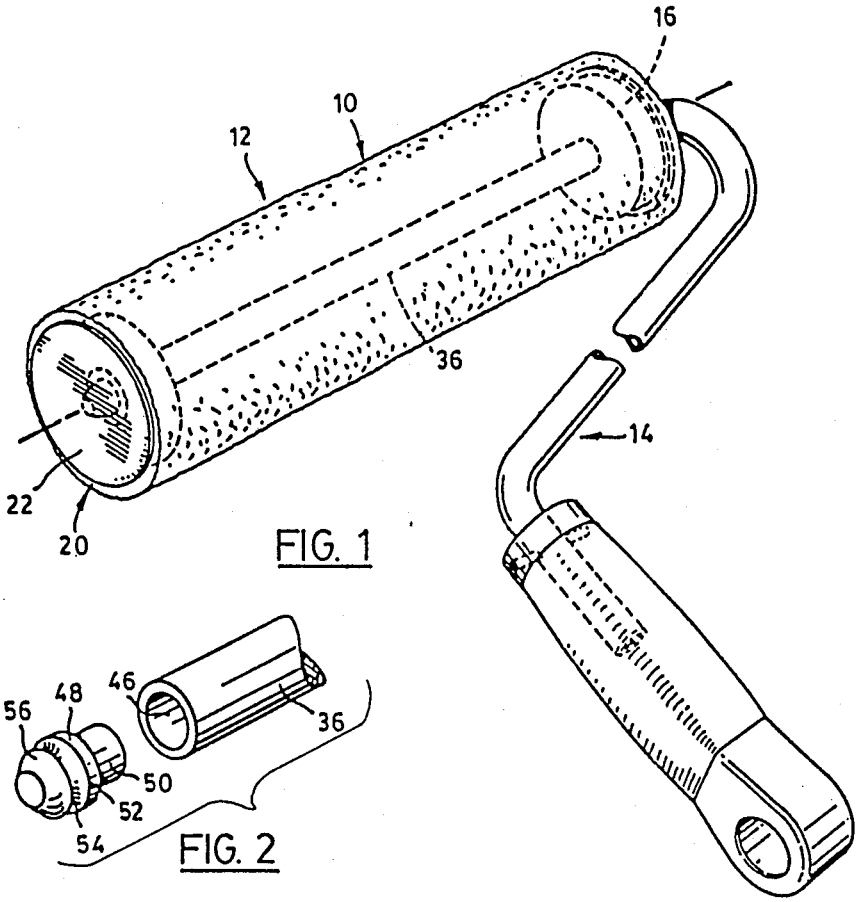
FIG. 2 is an enlarged detailed view of the plug which is located in the open end of the roller.

With reference to FIG. 1 of the drawings, the reference numeral 10 refers generally to a paint roller of the type in which a combination coupler and bearing support, in accordance with the present invention may be implied. The paint roller comprises a roller member 12 and a frame 14. The frame 14 includes a shaft portion 36, which has an opening 46 at the free end thereof within which a plug 48 is inserted. The plug 48 has a leg portion 50 adapted to fit within the passage 46 in a close-fitting relationship. A shoulder 52 projects radially, outwardly from the leg portion and has a diameter substantially equal to the external diameter of the shaft 36. A neck portion 54 of reduced diameter projects outwardly from the shoulder to a head portion 56. The head portion 56 is tapered at its outer end so as to facilitate the mounting of the head portion in the socket, as will be described hereinafter.

Figure 3:
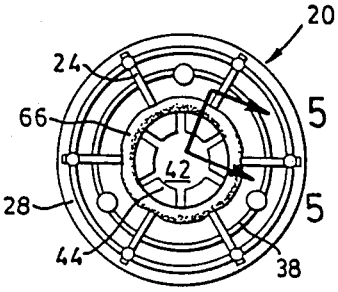
FIG. 3 is an end view of a combination coupler and support bearing constructed in accordance with an embodi-of the present invention.
Figure 4:
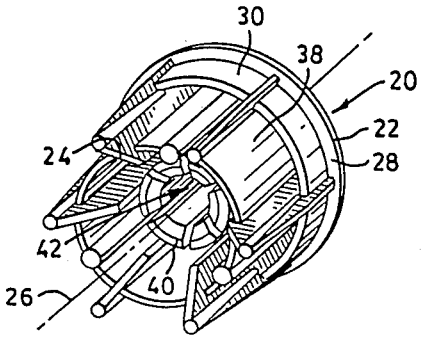
FIG. 4 is a pictorial view of the coupler and support bearing of FIG. 3.
Figure 5:
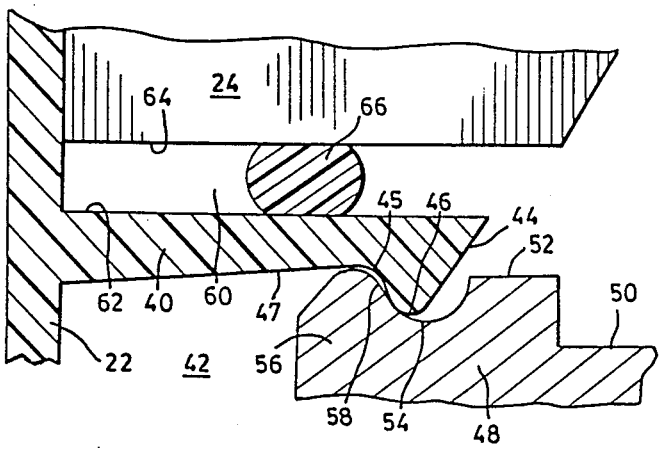
FIG. 5 is an enlarged sectional view taken through a portion of the bearing and showing a portion of a plug engaged by the locking fingers of the bearing.

The roller 12 has a first bearing 16 at one end thereof, and a combined coupler and support bearing 20 at the other end thereof. The improvements of the present invention are in the structure of the combined coupler and support bearing 20, which will now be described with reference to FIGS. 3 to 5 of the drawings.

As previously indicated, the reference numeral 20 refers generally to a combination coupler and support bearing. The combination coupler and support bearing 20 consists of an end roll 22, the outer face of which is flat and continuous, a plurality of stiffening ribs 24 project from the end wall 22 parallel to the longitudinal axis 26. The end wall projects radially, outwardly a short distance beyond the outer edge of the ribs 24 to form a small shoulder against which the end of a roll support tube will bear when the bearing is inserted within the end of a roll support tube, in use. A short skirt 30 projects longitudinally from the end wall 22 and serves to connect the ribs 24 adjacent their radial outer edges. A longer skirt 38 projects outwardly from the end wall and extends along a major portion of the length of the bearing. The skirt 38 is located at about half the radial length of the ribs 24, and serves to rigidly secure the ribs with respect to one another. A plurality of locking fingers 40 project from the end wall 22. The fingers 40 circumferentially spaced from one another about the axis 26 and form a socket 42 inwardly thereof. The socket 42 is proportioned to receive the plug 48 in a close-fitting relationship.

The locking fingers 40 project from the end wall 22, and have an inclined outer end portion 44 and a radially inwardly directed head portion 46 at the outer end thereof. An annular recess 60 is formed between the radially outer face 62 of each locking finger 40 and the radially inner face 64 of each reinforcing rib 24. This recess 60 extends from the end wall 22 to end of the locking fingers 40.

A resilient clamping member in the form of an O-ring 66 is positioned in the recess 60 and extends circumferentially about the locking fingers 40. The O-ring 66 has a relaxed thickness diameter which is greater than the radial extent of the recess 60, with the result that it is partially compressed between the fingers 40 and the stiffening ribs 24. The O-ring 66 serves to urge the clamping fingers 40 radially inwardly, and the clamping force which is applied can be varied by moving the O-ring 66 to any required position along the length of the recess 60. To increase the clamping force applied by the locking fingers, the O-ring 66 is moved toward the leading edge of the clamping fingers and to decrease the clamping force, the O-ring is moved toward the end wall 22.

Because of the resilient loading of the locking fingers by means of the resilient clamping member 66, I have found that I am able to form a radius at the inner edge 58 of the head portion 46 where it merges with the neck portion 54. In addition, I can form the portion 45 which extends between the inner edge of the head portion 46 and the radially inner face 47 of the fingers 40 with an arc of curvature, while retaining an adequate locking capability. These rounded interfaces serve to prevent an interlocking jamming of the fingers and the head which might otherwise occur in a barbed type of interlock.

The combination coupler and support bearing of the present invention may be made from a plastic material such as Nylon (trade mark), and may be formed by a conventional injection moulding process. The O-ring 66 may be made from conventional natural or synthetic rubber material or other similar plastic materials.

In use, the O-ring 66 is positioned at the required location within the recess 60, to provide the degree of interference fit required for a particular application, and thereafter, the combination coupler and support bearing is positioned within a paint roller 12, in a manner illustrated in FIG. 1, following which, the paint roller 12 may be mounted on the shaft 36 by inserting the shaft 36 through the bearing 16 and inserting the plug 48 into the socket 42. In order to remove the roller 12, it is merely necessary to withdraw the shaft 36 and thereby withdraw the plug 48 from the socket 42.

From the foregoing it will be apparent that the combined coupler and support bearing of the present invention is simple and inexpensive to manufacture, and provides a reliable resilient interlock between the roller assembly 12 and the frame assembly 14, in use.

I claim:

1. A combination coupler and support bearing comprising:

(a) an end wall, (b) roller support means projecting from said end wall and adapted to fit within an end of tubular support of a paint roller, (c) a plurality of locking fingers projecting from said end wall, each of said fingers having a free outer end spaced a substantial distance from said end wall, said locking fingers being circumferentially spaced with respect to one another about a longitudinal axis of rotation, and forming a socket radially inwardly thereof, said locking fingers being flexible to permit a plug to enter said socket, said locking fingers being spaced radially inwardly from said roller support means to provide an annular recess therebetween, said annular recess being axially elongated in the direction of said longitudinal axis of rotation and extend a substantial distance inwardly from the free outer ends of the fingers toward the end wall, (d) a resilient clamping member mounted in said recess and applying a radially, inwardly directed compressor force to the locking fingers serving to urge the locking fingers inwardly into locking engagement with the plug positioned in said socket in use, said resilient clamping member is in the form of a rubber O-ring having a thickness which is substantially less than the axial length of the recess so as to be positionable at any point along the length of the recess, to apply compressive forces which are proportional to the distance between the O-ring and said end wall.

2. A combinstion coupler and support bearing comprising:

(a) an end wall, (b) roller support means projecting from said end wall and adapted to fit within an end of tubular support of a paint roller, (c) a plurality of locking fingers projecting from said end wall, each of said fingers having a free outer end spaced a substantial distance from said end wall, said locking fingers being circumferentially spaced with respect to one another about a longitudinal axis of rotation, and forming a socket radially inwardly thereof, said locking fingers being flexible to permit a plug to enter said socket, said locking fingers being spaced radially inwardly from said roller support means to provide an annular recess therebetween, said annular recess being axially elongated in the direction of said longitudinal axis of rotation and extend a substantial distance inwardly from the free outer ends of the fingers toward the end wall, (d) a resilient clamping member mounted in said recess and applying a radially, inwardly directed compressor force to the locking fingers serving to urge the locking fingers inwardly into locking engagement with the plug positioned in said socket in use, said roller support means including stiffening means disposed radially outwardly from each locking finger, said stiffening means being radially spaced from said locking fingers a distance less than the relaxed diamete thickness of the O-ring, so as to compress the O-ring between each locking finger and said stiffening means, thereby to resist longitudinal movement of the O-ring with respect to the locking fingers, whereby a substantially constant compressive force may be applied to the fingers.

* * * * *